US005180155A

United States Patent [19]

Asai

[11] Patent Number: 5,180,155

[45] Date of Patent: Jan. 19, 1993

[54] APPARATUS FOR SEPARATING AND GRIPPING STACKED SHEETS

[75] Inventor: Toshimasa Asai, Chofu, Japan

[73] Assignee: Juki Corporation, Tokyo, Japan

[21] Appl. No.: 722,706

[22] Filed: Jun. 28, 1991

[30] Foreign Application Priority Data

Jun. 28, 1990 [JP] Japan ..... 2-171146

[51] Int. Cl.[5] ..... B65H 3/30

[52] U.S. Cl. ..... 271/21

[58] Field of Search ..... 271/21-23, 271/19, 16

[56] References Cited

U.S. PATENT DOCUMENTS 3,940,125 2/1976 Morton ..... 271/21 X 4,157,825 6/1979 Ellenberger et al. ..... 271/22 X

FOREIGN PATENT DOCUMENTS 2-169429 6/1990 Japan ..... 271/21

2117739 10/1983 United Kingdom ..... 271/21

*Primary Examiner*—David H. Bollinger

*Attorney, Agent, or Firm*—Morgan & Finnegan

[57] ABSTRACT

An apparatus for picking an uppermost sheet from a stack of sheets, having a rotatable take-up roller for pressing the stack to separate an uppermost sheet, a support member for supporting the take-up roller, and a drive mechanism for moving said support member. The apparatus further includes a guide member for guiding the support member in a outward direction, and an elastic retainer plate having one end secured to the guide member. The drive mechanism, responsive to the movement of the support member, is also used to rotate the take-up roller. The take-up roller and the retainer plate cooperate to clamp the separated sheet therebetween, for gripping and separating the sheet from its stack.

7 Claims, 8 Drawing Sheets

APPARATUS FOR SEPARATING AND GRIPPING STACKED SHEETS

FIELD OF THE INVENTION

This invention relates to an apparatus for separating and gripping the uppermost sheet from a plurality of sheets such as fabrics, workpieces and the like in a stack, and for transporting the same to another station.

BACKGROUND OF THE INVENTION

Stacked sheet separating and gripping apparatuses of this type are known in the art. See, for example, Japanese Patent Publication No. Sho 55-42023.

To better understand the background of this invention, a conventional stacked sheet separating and gripping apparatus will be briefly explained with reference to FIG. 23. In this device, a plurality of sheets S in a stack are laid on a stacker 51 and then urged upwardly by a take-up or a drag roller 53 which abuts against the stacker and which is positioned on its periphery. The drag roller 53 contains a plurality of flexible bristles 52 that radially extended from its surface.

A gripper or holder 54 is positioned at an incline to form a certain angle with the top of the stacked sheets. The gripper 54 includes a plurality of needle-like projections 55 extending from its surface.

The take-up or drag roller 53 is adapted for clockwise rotation to allow the bristles 52 to pick up and draw some of the upper sheets and deliver the uppermost sheet inside out to the gripper 54 when the roller is moved along a guide groove 56 that is parallel to the gripper 54.

When the roller 53 reaches the end of its travel and places the leading edges of the sheets on the gripper 54, the roller 53 is rotated in reverse to return to its lowermost position, leaving the uppermost sheet engaged with the projections 55 and retained on the gripper 54, while other sheets are returned to the stacked sheets S. Thereafter, the sheet on the gripper 54 is conveyed by a separately mounted gripper and conveyor mechanism to a predetermined station, and released.

Another known approach, as shown in FIG. 24, uses a take-up roller 61 having a plurality of bosses to abut against a stack of sheets S. The take-up roller 61 is rotated to bend the uppermost sheet into a loop in a clearance 64, defined by a stationary support 62 and a holder lever 63. Holder level 63 raises the loop from the sheet surface so that a spring 65 pivots the holder lever 63 about a shaft 66 to hold the loop between the stationary support 62 and the holder 63. A similar apparatus can be found, for example, in U.S. Pat. No. 3,940,125.

The conventional stacked sheet separating and gripping apparatuses discussed above require two independent and individual actuators with respect to rotation and displacement of the take-up rollers rendering the structures complicated, and involving troublesome operation.

Furthermore, these apparatuses lack a simplified means for gripping the sheets that remain on the gripper 54 and conveying the same to a given position. When using these apparatuses with a thin sheet, the bristles on the take-up rollers are likely to damage the sheet. The bristles also lack adaptability to the rigidity and pliability of the sheet, rendering a poor separation of one sheet from another.

Accordingly, there is a need for a stacked sheet separating and gripping apparatus that is capable of handling sheets of varying pliability and thicknesses, that is also simple in design and economical to manufacture.

SUMMARY OF THE INVENTION

It is therefore an object of the invention to eliminate the aforementioned disadvantages and shortcomings.

Another object of the invention is to provide an apparatus for separating and gripping sheets in a stack, which is capable of positively handling various types of the sheets.

Another object of the present invention is to provide a stacked sheet separating and gripping apparatus which is compact, lightweight and economical.

A further object of the invention is to provide a stacked sheet separating and gripping apparatus which is less expensive, more efficient, and more economical than the conventional types of apparatuses.

To accomplish these and other objects of the invention, a stacked sheet separating and gripping apparatus is provided, according to the invention. The apparatus includes a take-up or drag roller adapted to abut against the top of the sheets in a stack and to separate the uppermost sheet from the other sheets by frictional force, a support member for rotatably supporting the take-up or drag roller, a guide member for movably guiding the support member in a given direction, a retainer plate formed from an elastic material, one end of which is fixed to the guide member and the other end being adapted to hold the separated uppermost sheet between the take-up roller and its distal edge, and a drive mechanism for rotating the take-up or drag roller responsive to movement of the support member relative to the guide member.

The drive mechanism further includes a pinion concentrically secured to the take-up or drag roller, and a rack rigidly mounted on the guide member to mesh with the pinion. In addition, the guide member may be provided with guide slots through which a rotary shaft of the drag roller passes.

The drag roller may be formed of resilient material such as rubber or the like, having a high elastic modulus, to increase its long term durability. The retainer plate is provided with a ramp extended towards the sheet surface that is to be gripped, to prevent more than one sheet from being inadvertently gripped by the apparatus.

The drive mechanism is accordingly provided for rotating the drag roller, responsive to movement of a support member for the drag roller relative to a guide member, to rotate and shift the roller by the use of a common drive source.

The sheet may be gripped by rotating the roller in one direction and is moved and conveyed while being held between the roller and a retainer plate. Alternatively, the sheet as held, may be released only by rotating the roller in a reverse direction, to perform the sheet release operation very readily. The retainer plate is made of a resilient yet flexible material so that it can adjust to the varying thickness, stiffness, and pliability of the different types of sheets while still positively gripping the sheet.

The apparatus disclosed is made simple, compact, lightweight, and economical by the use of a rack and pinion mechanism for rotating the drag roller.

The guide member is formed with guide slots to guide the rotatable shaft of the drag roller and make its structure simple, such that the roller is moved parallel to the rack to ensure proper engagement of the pinion with the rack.

In one embodiment, the rack mounted on the guide member is held between the pinion and a guide roller so that the rack and the pinion may mesh with each other in better cooperation, irrespective of rack mounting accuracy and the guide roller position. The guide member may be formed with the support member having a guide roller rotatably mounted on a shaft that is parallel with the axis of the drag roller such that the rack may be interposed and clamped between the pinion of the take-up or drag roller and the guide roller.

In this embodiment, it is preferable that the shaft is eccentric. The shaft of the guide roller is made eccentric to finely adjust the distance between the shafts, thereby obtaining a better engagement of the rack with the pinion.

BRIEF DESCRIPTION OF THE DRAWINGS

The invention will be described in greater detail below with reference to the accompanying drawings, in which.

DETAILED DESCRIPTION OF THE INVENTION

Figure 1:
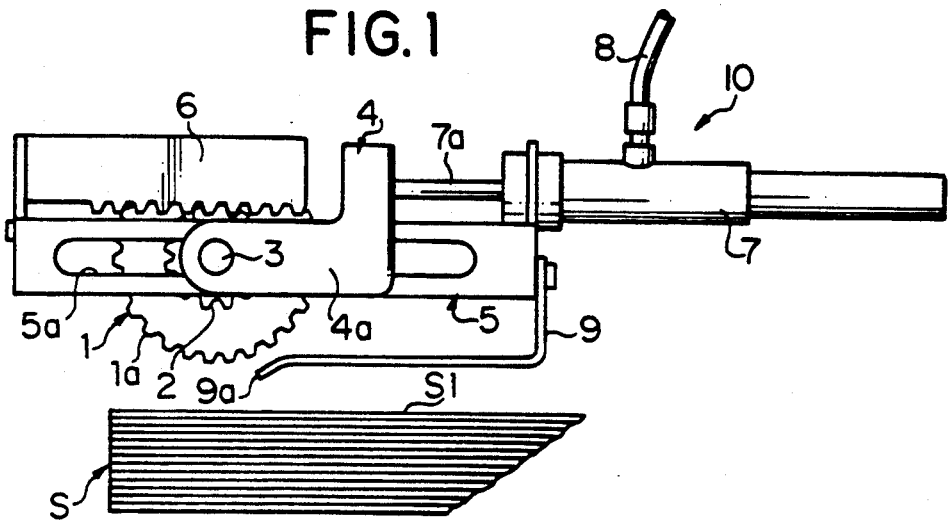
FIG. 1 is a front view of a stacked sheet separating and gripping apparatus according to a one embodiment of the invention.

Several embodiments of the present invention will now be described with reference FIG. 1 through FIG. 22, wherein like reference numerals refer to like parts and elements.

Figure 2:
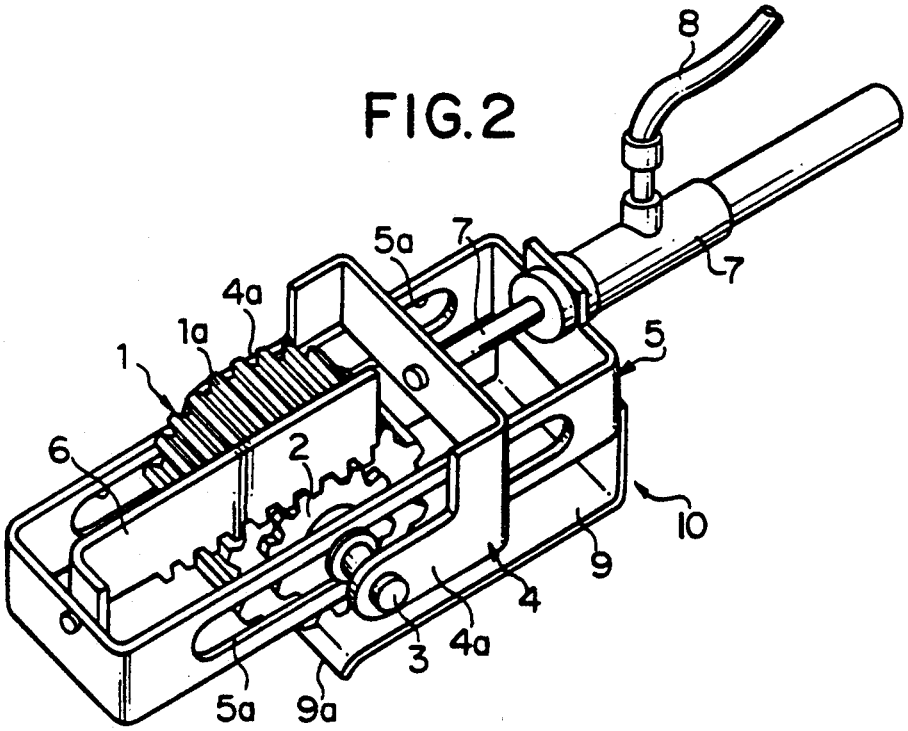
FIG. 2 is a perspective view of a stacked sheet separating and gripping apparatus.
Figure 3:
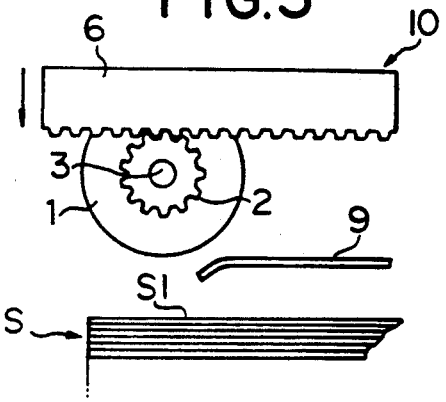
FIG. 3 through 7 are sequential views explanatory of the manner of operation of a stacked sheet separating and gripping apparatus.

FIG. 1 is a front view showing one embodiment of the present invention, and FIG. 2 is a perspective view of the same.

A drag roller 1, formed of an elastic material such as rubber or the like with a high elastic modulus, includes teeth 1*a* on its surface for providing a skid-proof surface. A pinion 2 is securely mounted on the side of a drag roller 1, such that the drag roller 1 and the pinion 2 are concentric. The ends of a pinion shaft 3 that passes through the centers of the pinion 2 and the drag roller 1, are rotatably journalled to a pair of arms 4*a* of support member 4.

A guide member 5 in the form of a rectangular frame, has a pair of guide slots 5*a*, into which the shaft 3 is rotatably and slidably connected. The guide member 5 is provided at its one end with a rack 6 whose teeth are disposed parallel to the guide slots 5*a*, so as to cooperate with the teeth of the pinion 2 of the drag roller 1.

An air cylinder activator 7 for providing translational motion to the support member 4 is fixed to guide member 5. A piston rod 7*a* of air cylinder activator 7 is connected to support member 4 by its distal end. A return spring (not shown) is connected on one end to support member 4 and on the other end to guide member 5, so as to oppose the motion of piston rod 7*a* and return support member 4 to its position prior to the activation of piston rod 7*a*.

A sheet separator and gripper apparatus 10 according to the present invention, is preferably mounted on one or more automatic conveyors or the like, which is arranged to correspond to dimensions of the sheets and to convey or transport the uppermost sheet from the stack of the sheets S to a desired station.

The operation of the sheet separator and gripper according to one embodiment will be described with reference to FIGS. 3 through 7.

Figure 4:
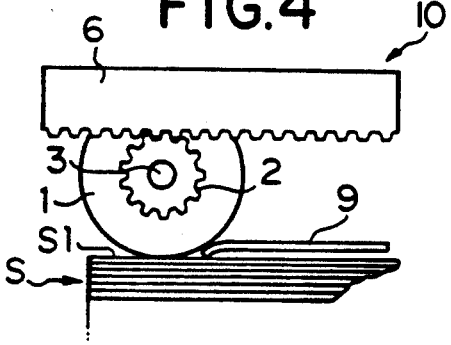

The separator and gripper 10 is positioned above the stack S of the sheets by the sheet conveyor or the like, and is then lowered to set the drag roller 1 and the retainer plate 9 on the top of the stack S, as shown in FIG. 4.

Air pressure fed to the air cylinder 7 (as shown in FIGS. 1 and 2), causes the piston rod 7*a* to extended outward, along with the support member 4, against the return spring. By movement of the support member 4, the shaft 3 is also moved accordingly. When air pressure is no longer supplied to the air cylinder 7 (as shown in FIGS. 1 and 2) of the apparatus 10, the piston rod 7*a* is retracted by the energized force of the return spring, moving the support member towards the air cylinder 7. At the same time, the pinion 2 and drag roller 1 are rotated counterclockwise by cooperating with the stationary rack 6, and are likewise moved along the length of guide slots 5A.

Figure 5:
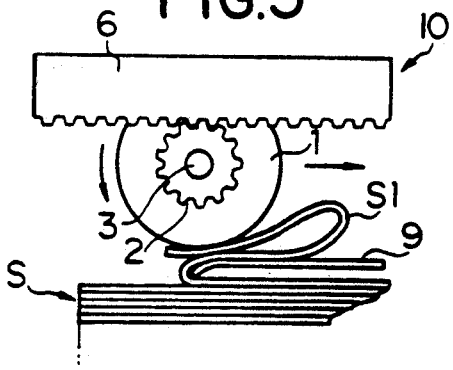
Figure 6:
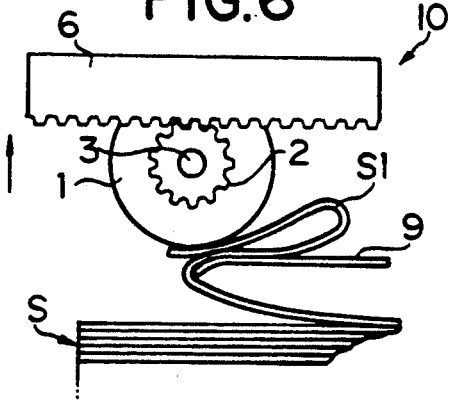
Figure 7:
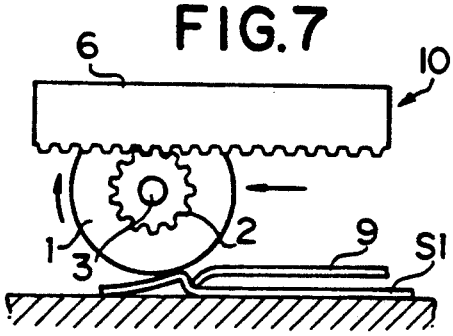

Consequently, the uppermost sheet S1 is pulled in or drawn by the drag roller 1 with frictional force and is separated from the stack S of the sheets. As is shown in FIG. 5, the uppermost sheet S1 is then clamped between the drag roller 1 and the retainer plate 9 and is pressed against the periphery of the drag roller 1 with elastic force of the retainer plate 9. At this moment, the frictional force generated at the interface between the drag roller 1 and the sheet S1 is aided by the teeth 1*a* formed on the surface of the drag roller 1, ensuring separation of the sheet from the stack S. The elasticity of the retainer plate 9 accommodates any varying thickness, rigidity and pliability of different sheets, thereby positively gripping any sheet S1. A sheet S1 is completely prevented from accidently releasing even if the apparatus 10 is lifted (as seen in FIG. 6) and conveyed to another station.

Lastly, the movement of the support member 4 away from guide member 5 rotates the pinion 2 and the drag roller 1 to release the uppermost sheet S1 held between the drag roller 1 and the retainer plate 9. See FIGS. 6 and 7.

According to the first embodiment, the drag roller 1 may occasionally drag or pick up more than one sheet at a time, depending upon such characteristics as the thickness, the material, the pliability, etc. of the sheet.

Figure 8:
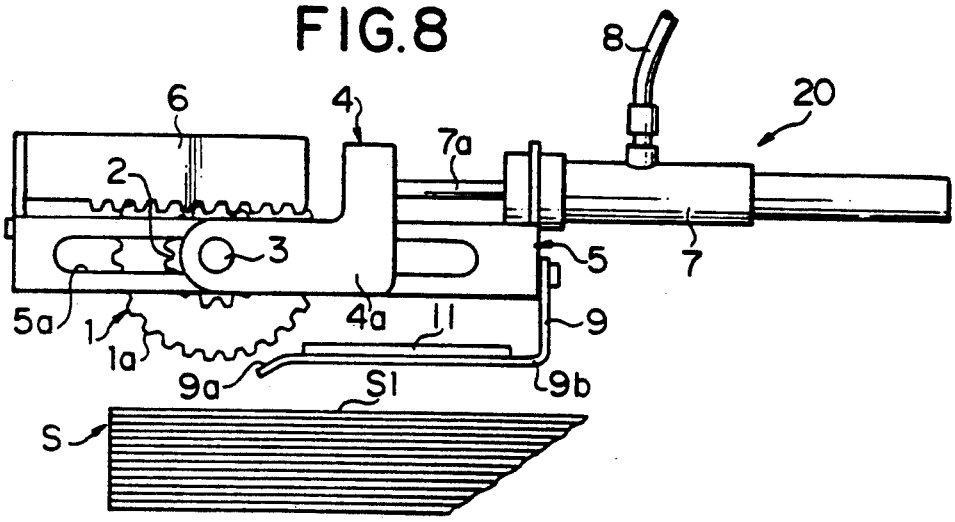
FIG. 8 is a front elevation of a stacked sheet separating and gripping apparatus according to another embodiment of the invention.
Figure 9:
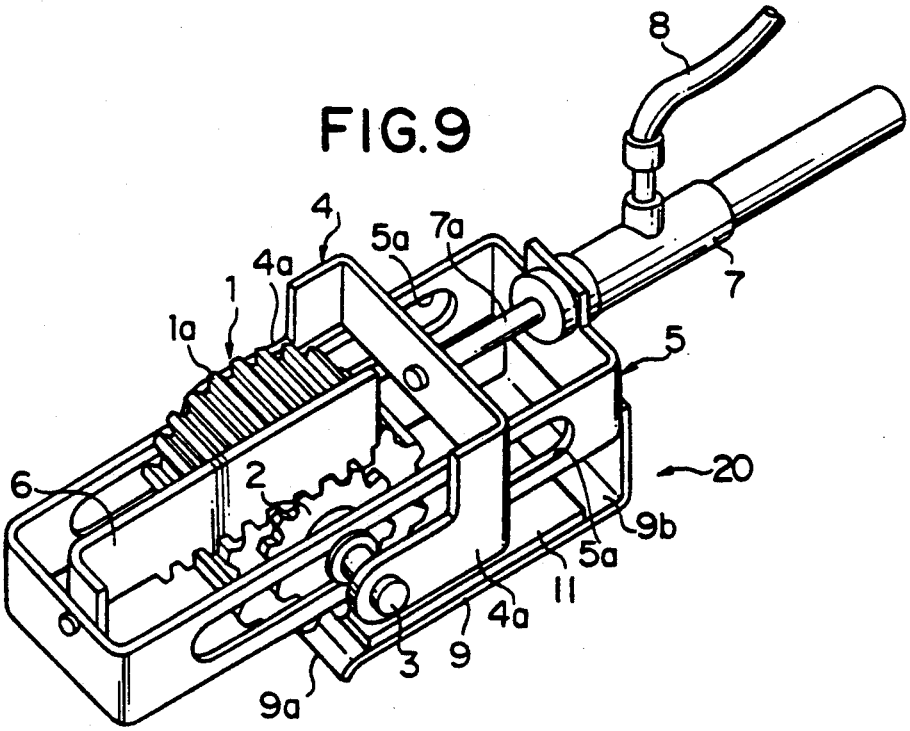
FIG. 9 is a perspective view of a stacked sheet separating and gripping apparatus, as illustrated in FIG. 8.

FIGS. 8 and 9 each show another embodiment of the invention in which the apparatus may accommodate different types of sheet materials used, such as sheets of varying thickness and pliability.

A sheet separator and gripper 20 shown in FIGS. 8 and 9 is similar in structure to the apparatus 10 in accordance with the above-mentioned embodiment. Advantageously, an additional spacer or separator 11 is attached to a sheet carrying surface 9*a* of the retainer plate 9.

The apparatus 20 of a second embodiment is comprised of basically the same elements and structure as disclosed in the above-mentioned embodiment shown in FIGS. 1 and 2, with the addition of spacer 11, so that its arrangement is not described here to avoid unnecessary duplication thereof.

Operation of the apparatus of the second embodiment will be apparent from the description, with reference to FIGS. 10 through 13, wherein the apparatus is adapted to handle such conditions as inadvertently picking up more than one sheet at a time.

Figure 10:
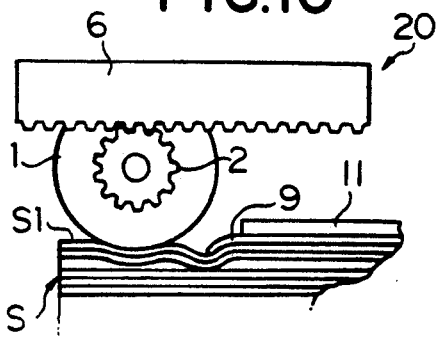
FIGS. 10 through 13 are sequential views explanatory of the manner of operation of another stacked sheet separating and gripping apparatus.
Figure 11:
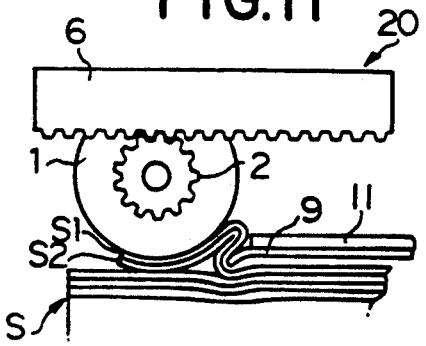

As shown in FIG. 10, the pressure in air cylinder 7 is released, allowing the support member to travel from left to right after the apparatus 20 is set to the top of the stack S. The drag roller 1 is simultaneously rotated counterclockwise and driven toward the retainer plate 9, to drag and pull, with frictional force, the uppermost sheet S1 and the next sheet S2 into the clearance between the drag roller 1 and the retainer plate 9. The folds of the sheets abut against the edges of the ramp 9*a* of the retainer plate 9 and one end of the spacer or separator 11, as illustrated in FIG. 11.

Figure 12:
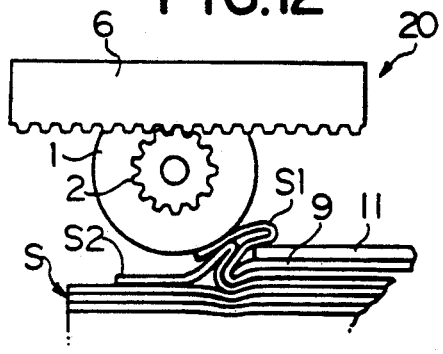

By further rotation and rightward displacement of the drag roller 1, only the sheet 1 is further pulled or drawn, as illustrated in FIG. 12. The sheet S2, as shown in FIGS. 12 and 13, is not pulled any further due to slippage between the sheets S1 and S2 since friction between the sheet S1 and the roller 1 is greater than that between the sheets S1 and S2.

Figure 13:
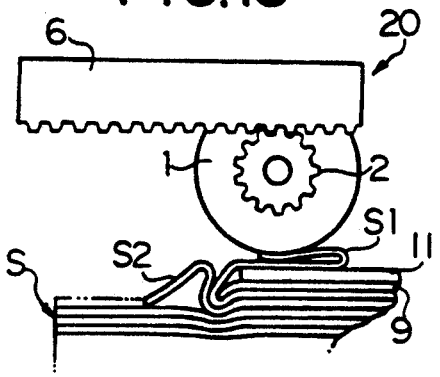

Referring now to FIG. 13, the drag roller 1 is rotated further while continuing its travel, and the sheet S1 is held between the drag roller 1 and the spacer or separator 11, whereas the sheet S2 is returned to the position indicated by the dotted line with its restoring force, preventing more than one sheet at a time from being gripped or dragged.

Figure 14A:
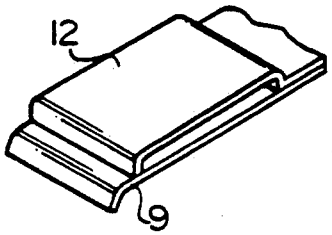
FIGS. 14*a*, 14*b*, and 14*c* are views each showing a modified form of a retainer plate incorporated in the apparatus.
Figure 14B:
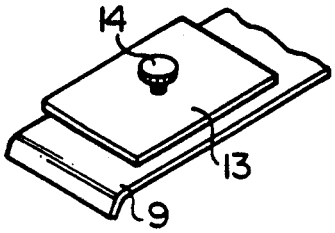
Figure 14C:
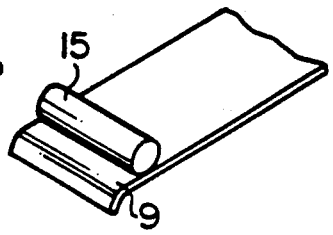

In this embodiment, the retainer plate 9 may include different configurations of spacer 11, for instance, a thin plate 12 whose opposite ends are bent (see FIG. 14*a*), a height adjust screw 14 for adjusting the height of the thin plate 13 (see FIG. 14*b*), and a block 15 such as a column, a square pillar, a cylinder or the like mounted on the plate 13 (see FIG. 14*c*).

The second embodiment mentioned above is contemplated to avoid gripping or drawing more than one sheet at a time, and accordingly the apparatus 20 may be adjusted to accommodate the various thicknesses of the sheets. Because the separator 11 is fixed to the sheet carrying surface of the retainer plate 9, the apparatus 20 may be adjusted by bending the retainer plate 9 upwardly so as to lessen the clearance between drag roller 1 and ramp 9*a*, thereby reducing any difficulty in holding a sheet therebetween.

Figure 15:
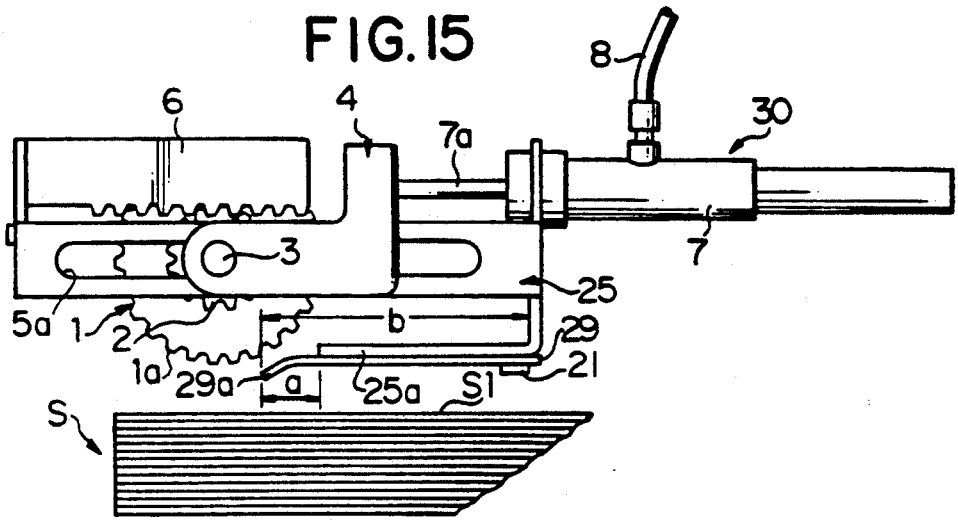
FIG. 15 is a front view of a stacked sheet separating and gripping apparatus according to yet another embodiment of the invention.
Figure 16:
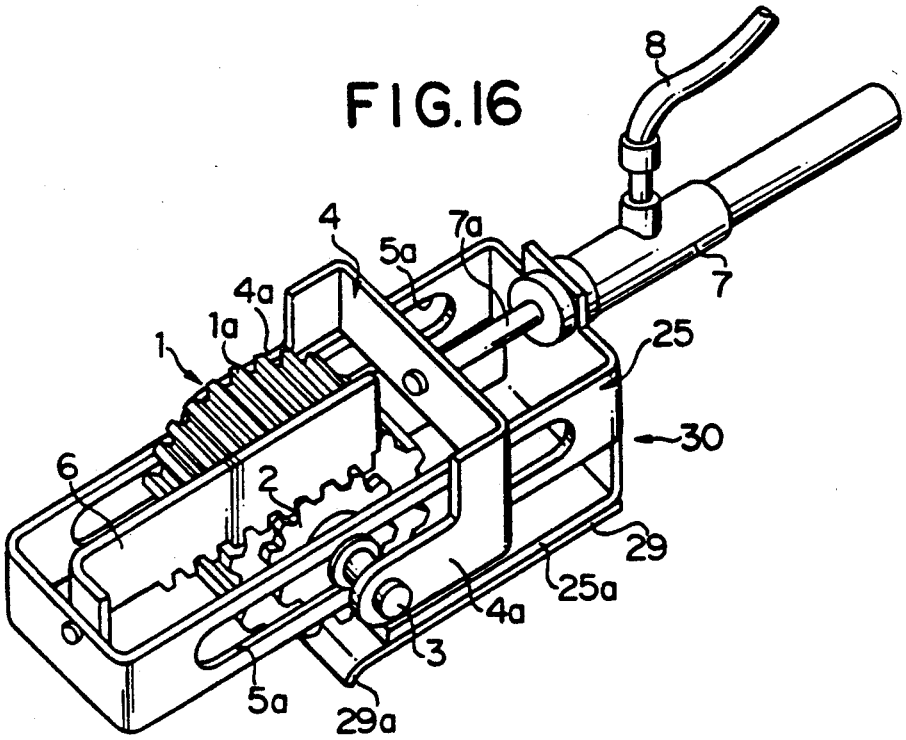
FIG. 16 is a perspective view of a stacked sheet separating and gripping apparatus, as illustrated in FIG. 15.

FIGS. 15 and 16 show an aspect according to yet another embodiment for ensuring and facilitating gripping the sheet S1 without any difficulty.

In a third embodiment, the guide member 25 is modified to obtain a guide member 25 as provided, with an L-shaped frame 25*a* disposed below the guide member 25 and integrated therewith. A separator and gripper 30 in this embodiment is arranged so that a retainer plate 29 is secured to the bottom of frame 25*a* at its proximal end, by a set screw 21. The straight retainer plate 29 is dimensioned such that the length "a" from the distal edge of retainer plate 29 to the distal edge of frame 25*a* is much less than the length "b" from the distal edge of frame 25*a* to the point where it bends 90°. Furthermore, it is preferable to make frame 25*a* sufficiently rigid so as to prevent the clearance between the roller 1 and the retainer plate 29 from being narrowed or lessened when the apparatus 30 is set on top of stack S.

The separator and gripper apparatus 30 is similar to the apparatus 20 in all other respects, except for the arrangement mentioned above.

Operation of the sheet separator and gripper apparatus according to the third embodiment will now be described with reference to FIGS. 17 through 20.

Figure 17:
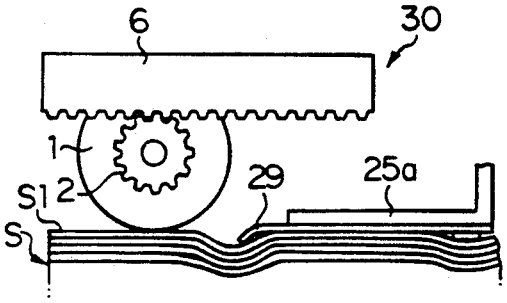
FIGS. 17 through 20 are sequential views explanatory of the manner of operation of yet another stacked sheet separating and gripping apparatus.
Figure 18:
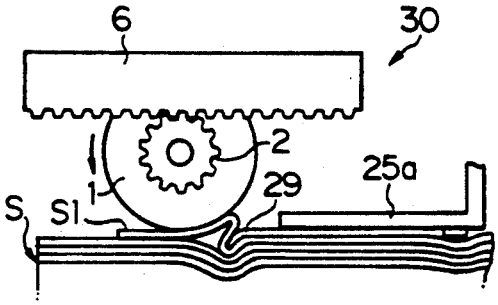
Figure 19:
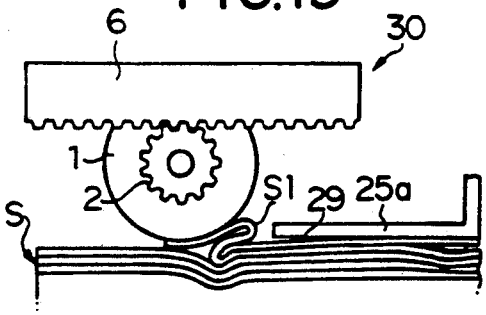

The apparatus 30 is initially set to the top of the sheets S as shown in FIG. 17. When the drag roller 1 is rotated counter-clockwise and displaced towards the retainer plate 29, the uppermost sheet S1 is folded by the drag roller 1 (as seen in FIG. 18) and then clamped between the drag roller 1 and the retainer plate 29. Advantageously, the length b from the distal end of the retainer plate 29 to the bend of frame 25*a* is long enough to allow some flex in frame 25*a*, thereby readily gripping an even thicker sheet.

Figure 20:
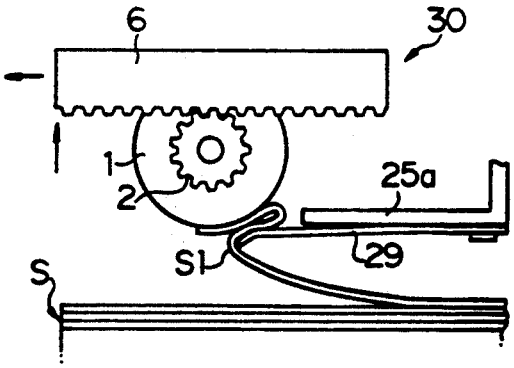

Upon gripping the sheet, the gripper and separator apparatus 30 is raised or lifted as shown in FIG. 20 and is moved away from the stack S. Notably, the sheet S1 is prevented from falling during movement of the apparatus 30 because the sheet S1 is held by the frictional force of the retainer plate 29 pressed against the drag roller 1 with the sheet S1 therebetween.

Figure 21:
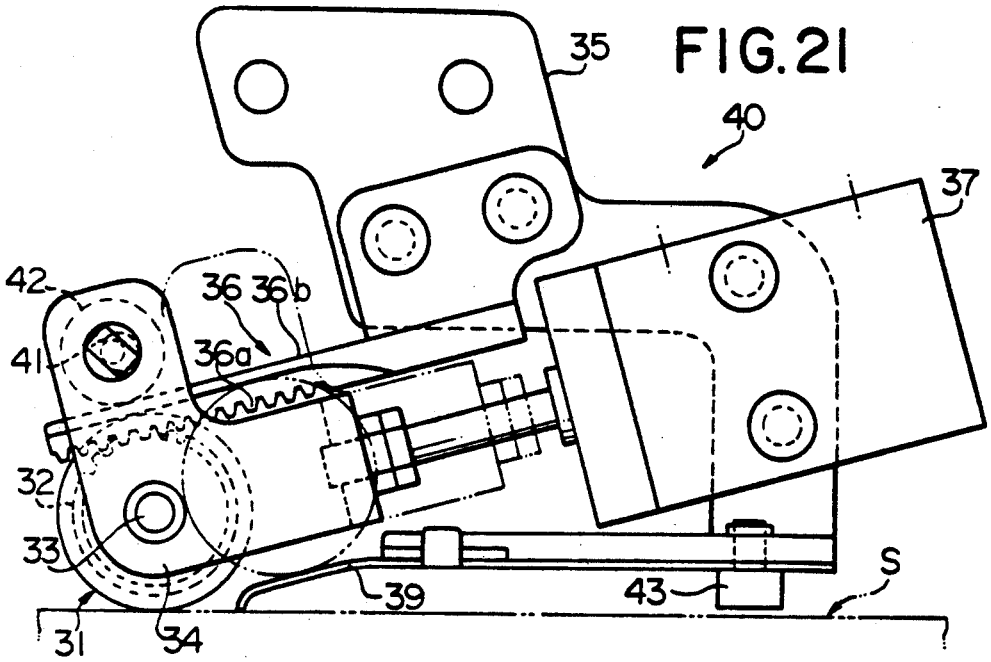
FIG. 21 is a front view of a stacked sheet separating and gripping apparatus according to still another embodiment of the invention.
Figure 22:
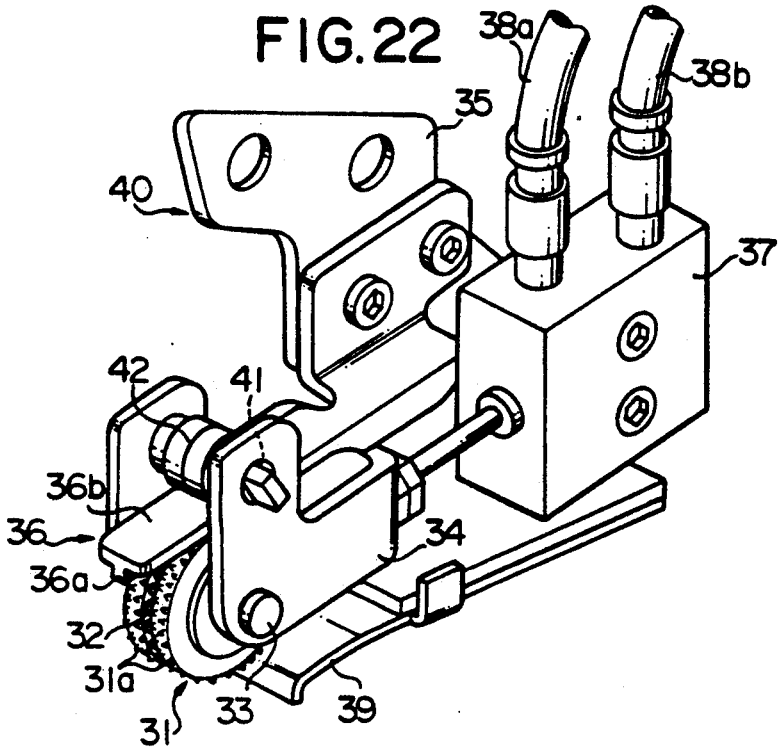
FIG. 22 is a perspective view of a stacked sheet separating and gripping apparatus, as illustrated in FIG. 21.
Figure 23:
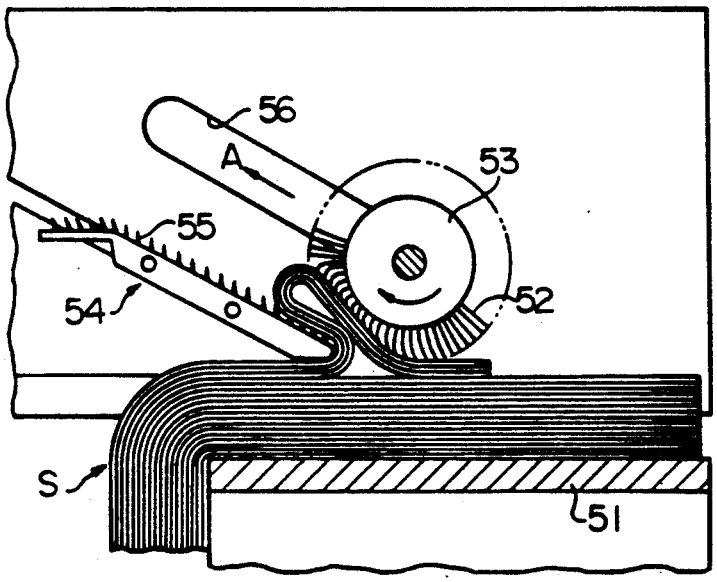
FIG. 23 is a front elevation, showing by way of example, of a conventional stacked sheet separating and gripping apparatus.
Figure 24:
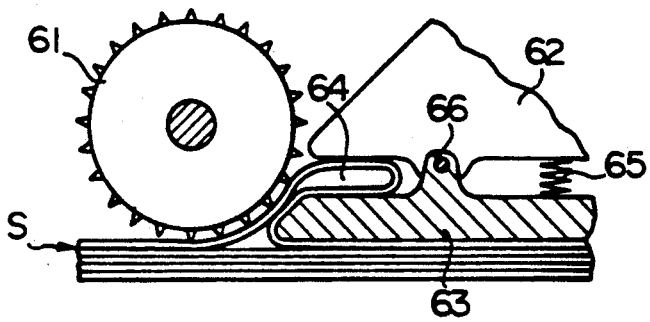
FIG. 24 is a front view showing, by way of example, another conventional sheet separating and gripping apparatus.

FIGS. 21 and 22 illustrate an apparatus for separating and gripping stacked sheets according to still another embodiment of the invention. This embodiment may ensure an improved engagement of a rack with a pinion.

A sheet separator and gripper apparatus 40 is embodied such that a roller 31 has a plurality of lugs 31*a* on its surface, and a pinion 32 mounted concentrically to its side. An axial shaft 33 of the drag roller 31 and the pinion 32 is rotatably journalled to a support member 34. An eccentric shaft 41, which is mounted on the support member 34 and parallel to shaft 33, includes a guide roller 42 rotatably journalled thereto.

An angled guide member 35 is formed on the vertical surface of apparatus 40, having an angled rack 36 integral therewith. The rack 36 includes teeth 36*a* on its underside. When the eccentric shaft 41 is rotated, the rack 36 is clamped between the guide roller 42 and the pinion 32 whereby an upper surface 36*b* of the rack 36 is in contact with the guide roller 42 while the rack teeth 36*a* mesh with the teeth of the pinion 32.

An air cylinder 37 is mounted on the guide member 35 along its vertical surface, with its piston rod connected to the support member 34. The air cylinder 37 is coupled by pipe conduits 38*a* and 38*b* to an air pressure source via an electromagnetic valve (not shown).

A retainer plate 39 of resilient material is secured by a set screw 43 to the guide member 35 on its horizontal base.

In accordance with this embodiment, the rack 36 is held from above and beneath, between the guide roller 42 and the pinion 32 so that engagement of the rack teeth 36*a* with the pinion 32 is maintained stable at all times. The distance between the guide roller 42 and the pinion 32 may be finely adjusted without interruption, by rotation of the eccentric shaft 41 to adjust engagement of the rack with the pinion under optimum conditions.

This embodiment of the invention is similar in operation to the third embodiment.

In operation, the drag roller 31 is initially placed against the top of a stack of sheets. The support member 34 is moved across the top of the stack, while drag roller 31 is rotated in a counter-clockwise direction by the drive means.

In this manner, rotation of the drag roller 31 is actuated by the movement of the support member 34 relative to the guide member 35, resulting in the use of only one actuator, thereby rendering the apparatus compact, lightweight, and economical. Notably, the rack and pinion mechanism is used as a drive means for rotating the drag roller 31 in a very simple manner. The guide roller 42 may be provided with guide slots (not shown) to guide the rotary shaft and move the guide roller 42 in parallel with the rack 36 in a very simple manner to ensure the proper engagement of the pinion 32 with the rack 36.

Upon rotation of the drag roller 31, only the uppermost sheet is separated from the remaining sheets and held between the drag roller 31 and a retainer plate 39. In this condition, the sheet is pressed between the drag roller 31 and the retainer plate 39 with sufficient force to prevent the sheet from slipping and falling.

Subsequently, the apparatus 40 is raised and transported to a desired sewing station whereupon the support member 34 is reversely shifted so that the drag roller 31 is reversely rotated to release the gripped sheet.

In this embodiment, the guide member 35 is formed with the rack 36 which is held between the pinion 32 of the drag roller 31 and the guide roller 42 so that the rack 36 and the pinion 32 are engaged with each other in a better cooperation irrespective of the mounting accuracy of the rack. When the shaft of the guide roller 42 is of the eccentric type, the eccentric shaft 41 may be rotated to obtain better engagement of the rack 36 with the pinion 32.

The drag roller 31 may be made of a resilient material such as rubber or the like, to increase its durability and thus be used for a long time. The retainer plate 39 may also include an additional spacer means whose edge projects above the surface of the retainer plate 39, so as to prevent the apparatus 40 from gripping more than one sheet at a time.

Although each of the embodiments described above has been referred to as including a rack and pinion mechanism which is used as a drive means for rotating the drag rollers in response to movement of the support member relative to the guide member, it is understood that the invention is not limited to such a mechanism. For example, a pulley which is integrally formed with the drag roller maybe adapted for rotation by a rope, one end of which is fixed to the guide member, the other end being secured to a weight. Alternatively, a link may be provided to connect the guide member to the distal end of a lever mounted radially on the drag roller, to reciprocally rotate the drag roller at a given angle. Also, the support member which supports the drag roller may be fastened stationally whereas the guide member may be moved.

While the invention has been described in detail with particular reference to the specific embodiments herein, it will be apparent that many modifications and variations may be easily effected by one skilled in the art without departing from the spirit or scope of the novel concepts of the present invention, as defined in the appended claims.

What is claimed is:

1. An apparatus for picking an uppermost sheet from a stack of sheets comprising:

a rotatable take-up roller for pressing the stack to separate the uppermost sheet;

a support member for rotatably supporting said take-up roller;

a guide member slidably engaged with said support member for guiding movement of said support member;

drive means connected to said support member for slidably moving said support member with respect to said guide member, said drive means located between said take-up roller and said guide member, and in operative engagement with said take-up roller and said guide member whereby sliding movement of said support member with respect to said guide member is translated into rotational movement of said take-up roller; and an elastic retainer plate for clamping said separated sheet in cooperation with said take-up roller, said retainer plate having one end secured to said guide member.

2. An apparatus according to claim 1 wherein said drive means includes a pinion concentrically secured to said take-up roller and a rack secured to said guide member.

3. An apparatus according to claim 1 wherein said take-up roller is made of a material further comprising a high frictional coefficient.

4. An apparatus according to claim 1 wherein said retainer plate includes a stepped portion positioned adjacent to a distal edge of said retainer plate.

5. An apparatus for picking an uppermost sheet from a stack of sheets comprising:

a rotatable take-up roller for pressing the stack to separate the uppermost sheet;

a support member for rotatably supporting said take-up roller;

a guide member slidably engaged with said support member for guiding movement of said support member, wherein said guide member comprises a plurality of guide slots for guiding said take-up roller;

drive means connected to said support member for slidably moving said support member, with respect to said guide member, wherein said drive means includes a pinion concentrically secured to said take-up roller and a rack secured to said guide member, said pinion engaged with said rack so that movement of said support member with respect to said guide member causes relative movement between said pinion and said rack thereby rotating said take-up roller; and an elastical retainer plate for clamping said separated sheet in cooperation with said take-up roller, said retainer plate having one end secured to said guide member.

6. An apparatus for picking an uppermost sheet from a stack of sheets comprising:

a rotatable take-up roller for pressing the stack to separate the uppermost sheet;

a support member for rotatably supporting said take-up roller;

a guide member slidably connected to said support member for guiding movement of said support member;

drive means connected to said support member for slidably moving said support member with respect to said guide member, wherein said drive means includes a pinion concentrically secured to said take-up roller and a rack secured to said guide member, said pinion engaged with said rack so that movement of said support member with respect to said guide member causes relative movement between said pinion and said rack thereby rotating said take-up roller;

a guide roller having a shaft parallel with the axis of said take-up roller, said guide roller rotatably mounted on said support member to engage said rack in cooperation with said pinion; and an elastic retainer plate for clamping said separated sheet in cooperation with said take-up roller, said retainer plate having one end secured to said guide member.

7. An apparatus for picking an uppermost sheet from a stack of sheets comprising:

a rotatable take-up roller for pressing the stack to separate the uppermost sheet;

a support member for rotatable supporting said take-up roller;

a guide member slidably connected to said support member for guiding the movement of said support member;

drive means connected to said support member for slidably moving said support member with respect to said guide member, wherein said drive means includes a pinion concentrically secured to said take-up roller and a rack secured to said guide member, said pinion engaged with said rack so that movement of said support member with respect to said guide member causes relative movement between said pinion and said rack thereby rotating said take-up roller;

a guide roller having a shaft parallel with the axis of said take-up roller, said guide roller rotatably mounted on said support member to engage said rack in cooperation with said pinion secured to said take-up roller, wherein said shaft of said guide roller is eccentric with respect to said axis of said take-up roller; and an elastic retainer plate for clamping said separated sheet in cooperation with said take-up roller, said retainer plate having one end secured to said guide member.

* * * * *